US005839728A

United States Patent [19]

Kao

[11] Patent Number: 5,839,728

[45] Date of Patent: Nov. 24, 1998

[54] METHOD OF PLAYING A DICE CASINO GAME

[76] Inventor: Ming Pan Kao, 5263 Corinne Ct., #74, Las Vegas, Nev. 89103

[21] Appl. No.: 910,492

[22] Filed: Aug. 6, 1997

[51] Int. Cl.[6] ..... A63F 3/00

[52] U.S. Cl. ..... 273/274

[58] Field of Search ..... 273/274, 146, 273/309

[56] References Cited

U.S. PATENT DOCUMENTS

| | | | |
|---|---|---|---|
| 2,861,809 | 11/1958 | Fischl | 273/141 R |
| 3,747,935 | 7/1973 | Engelbrecht | 273/146 |
| 4,129,304 | 12/1978 | Mager | 273/246 |
| 4,247,114 | 1/1981 | Carroll | 273/274 |
| 4,312,508 | 1/1982 | Wood | 273/274 |
| 4,635,938 | 1/1987 | Gray | 273/274 |
| 4,711,453 | 12/1987 | Saint Ive | 273/268 |
| 4,746,126 | 5/1988 | Angileri | 273/249 |
| 4,900,034 | 2/1990 | Bereuter | 273/274 |
| 4,930,780 | 6/1990 | Goodman et al. | 273/146 |
| 5,133,559 | 7/1992 | Page | 273/274 |
| 5,265,881 | 11/1993 | Doherty | 273/274 |
| 5,308,081 | 5/1994 | Bartle | 273/274 |
| 5,350,175 | 9/1994 | DiLullo et al. | 273/146 |
| 5,405,145 | 4/1995 | Jones et al. | 273/146 |
| 5,513,850 | 5/1996 | Vancura | 273/274 |
| 5,542,671 | 8/1996 | Stewart | 273/146 |
| 5,556,101 | 9/1996 | Jabro | 273/274 |

*Primary Examiner*—Benjamin H. Layno
*Attorney, Agent, or Firm*—John C. Lambertsen

[57] ABSTRACT

An independent event dice game that is easy-to-play provides dice to each player and to the dealer or house. After all bets are placed, the players sequentially throw their respective dice, with the throw results separately kept for each player. The dealer's dice are then likewise thrown, with winning players defined as those having dice throws of greater numerical value that the dice throw of the dealer. Certain numeric values are defined to be "wild," and dice throw values of "2", "11", and "12" for a player will win regardless of the dealer's throw value. In a similar manner, the dealer throw value of "3" is also considered to be "wild", and will win over any player-thrown value except the "wild"values of "2", "11", and "12". At the conclusion of each play, all dice are collected to a central location, and are then distributed by the dealer after bets are placed for the next succeeding game.

18 Claims, 1 Drawing Sheet

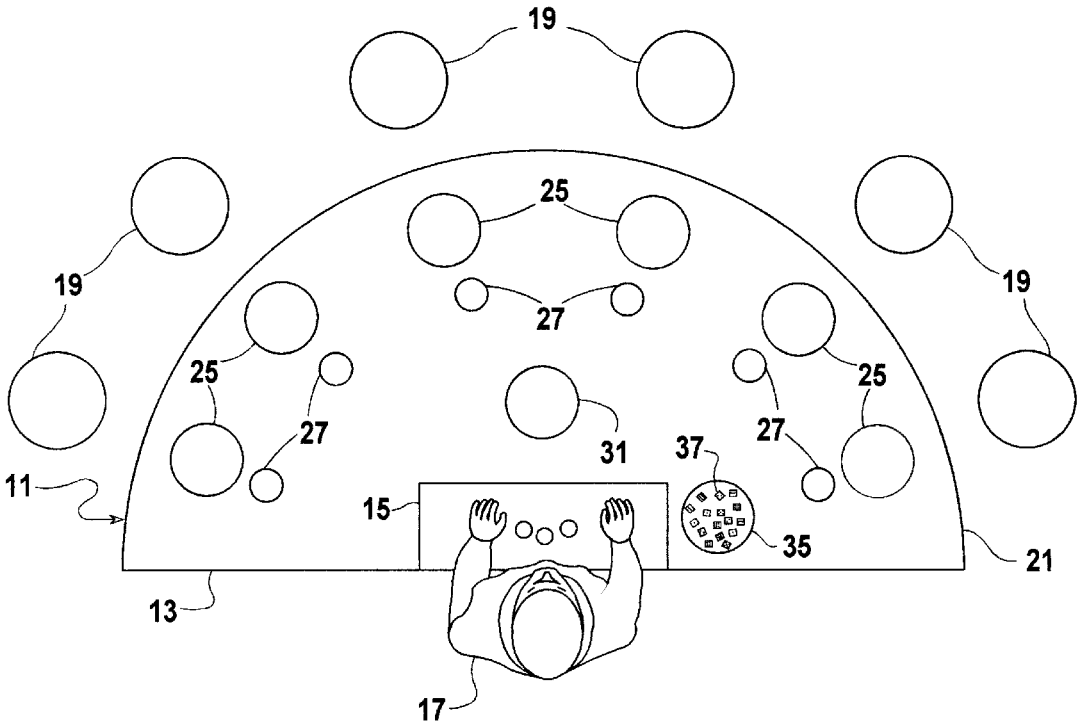
19
19
19
25
27
25
27
25
27
31
37
11
15
35
21
13
17

METHOD OF PLAYING A DICE CASINO GAME

BACKGROUND OF THE INVENTION

1 Field of the Invention

The present invention relates to a game of skill and chance and, more particularly, to an improved dice game for use in casinos.

2 Description of the Prior Art

Casino games provide wagering events of two general types, independent, where each event is isolated from all previous or subsequent events, and dependent, where a present event is or can be affected by prior events. An example of the latter are playing card games, such as Blackjack, where there is no shuffle between hands.

Independent wagering events include such games as craps, roulette, and the various games employing random number generators, including slot machines and video poker. All else being equal, a casino prefers independent games to eliminate the ability of bettors to contrive mathematical systems to affect wagering odds. Understandably, casino games must have a positive wagering expectation for the house, and the more desirable have fewer ways in which players can manipulate the odds to decrease the positive expectation of the house.

From a player's perspective, a successful casino wagering game must be easy to understand, mechanically simple to effect, and fun to play. All successful table games share these attributes, and those enjoying the most success in recent times also share the characteristic that a player wagers against the house, and not fellow players. As an example, in Blackjack, both the player and the dealer have separate hands that are played in a competitive manner by each. Players are able to witness the development of each, individual hand against the dealer to determine the winner or winners at that table, with the house paying all winning wagers.

Player interest in a game is believed to be greater where the players physically interact in a game. Tactile sensations provided by the holding of playing cards or by rolling dice greatly increase the psychological involvement of the player with a game, without requiring a high level of physical skills. Many players believe that by "touching" the gaming apparatus, their wagering destiny is somehow controllable.

Although required to ultimately favor the house, it is desirable that the apparent wagering odds are substantially the same for the player and the dealer. For independent event games where the player(s) and dealer have separate "hands," certain asymmetrical events must be included to insure a statistical edge in the odds to favor the house. This can occur by either constructing the dealer's "hand" in a manner that is preferentially stronger, or by structuring the payoffs to favor the dealer, such as "bar" hands or rules such as the "dealer wins ties".

Present casino dice games lack one or more of these advantageous characteristics. For example, in addition to having incredibly complex betting conventions, craps requires the player to achieve a certain roll or sequence of rolls to win a game. There is no "dealer hand," and the "dealer" only interacts as banker and game supervisor. Additionally, only one of the players is "touching" the dice during any one game, with the majority of players at a craps table "interacting" only to the extent of placing wagers.

It is therefore important to realize an independent event dice game with easy-to-learn rules, where players compete against a dealer. Ideally, such a dice game would provide each player the opportunity to physically manipulate his or her own dice, attempting to best the results of a similar manipulation by the dealer. Wagering results must be readily apparent, with added excitement resulting from certain specialized event results that cause certain player results to "trump" or override what would otherwise be winning dealer combinations. Likewise, certain dealer results would then override player results, providing an overall result where the house enjoys a statistical payoff advantage.

Preferably, such a game would have a relatively small cycle time between rounds, so that more cycles of the game can be played over a given period of time. Such a game would have reasonable odds, and would be easy to understand and play, requiring few decisions on the part of a player. Finally, the equipment for such a game must be relatively inexpensive to manufacture and be easy for the casino to maintain.

SUMMARY OF THE INVENTION

These and other problems of known casino dice games are successfully addressed and overcome by the present invention, where one or more dice are equally distributed to the players and the dealer. The event results of each player are independently played against the event result obtained by the dealer.

The present invention provides a method for playing a betting game employing one or more conventional, six-sided dice (or their video or mechanical equivalent). The game is played around a table layout that is similar to that used for Blackjack. Each player is provided a separate dice bowl, as is the dealer, with the requisite number of dice distributed to each player before the play of every game, and collected at the conclusion of each such game.

In general, a player's score is determined by the point total resulting from that player's throw of the required number of dice. The score of each player is then sequentially compared to the thrown point total of the dealer's dice. Players win or lose on an individual basis, based upon the point total obtained by their respective throws.

In a preferred embodiment, the players are provided certain wildcard scores that win, regardless of the dealer's point total. Likewise, the dealer is provided a wildcard score that wins over every player point total, except the aforesaid wildcard values.

Further objects and advantages of the invention will be brought out in the following portions of the specification. Also, so that this invention may be more readily understood, one form of table will be described below, in association with the accompanying drawings. Additionally, while set out hereinafter are, effectively, the rules of the game, it is to be understood and appreciated that the detailed description is for the purpose of fully disclosing preferred embodiments of the present invention without placing limitations thereon.

BRIEF DESCRIPTION OF THE DRAWING

FIG. 1 is a plan view of the table showing a useful playing surface for one embodiment of the present invention.

DETAILED DESCRIPTION OF THE PREFERRED EMBODIMENTS

A playing surface 11 is shown in FIG. 1, and is of a semi-circular design that is appropriate for being placed upon a Blackjack table. A linear edge 13 forms the "house" or "dealer" side, with a chip tray area 15 centrally located along the linear edge 13. A dealer 17 is shown in position adjacent the chip tray area 15. A plurality of player areas 19 are spaced equidistantly along a curved edge 21 of the playing surface 11. It is to be understood and appreciated that while FIG. 1 depicts six of the player areas 19, greater numbers of players are possible, and are limited only by considerations of table space and game cycle time.

A plurality of player dice-receiving areas 25 are spaced about the curved edge 21 of the playing surface 11 at locations that radially correspond to the location of the player areas 19. Preferably adjacent each of the player dice areas 25 are located player betting areas 27, with each player preferably provided a separate one of the player dice areas 25 and the player betting areas 27, to the exclusion of any other player during the play of a game.

In a similar manner, the dealer 17 is provided a separate, dealer dice-receiving area 31. The dealer 17 is also provided a dice storage area 35 having a plurality of dice 37 located therein. The dice storage area 35 receives all of the dice from each of the player dice-receiving areas 25 between each individual game. The dice 37 located in the dice storage area 35 in turn are used to supply each of the players and the dealer 17 with the dice required for the next game. In this manner, the dice used by each player are changed from game to game, minimizing the opportunities for dealer or player cheating.

In a preferred embodiment, the playing surface 11 is formed of a felt or like material, and the various defined areas are placed on the playing surface by a silk screen process.

To describe the operation of the invention, set forth in the following are the rules of play:

In a preferred version of the game, two dice are used by each of the players and the dealer. The dice, while conventional in terms of being six-sided and having face numbers of from "1 "–"6", can also be specially marked using a red color to differentiate certain of the face numbers. Specifically, in a preferred version, dice face numbers "1"and "4 " are of a red color, and dice face numbers "2", "3", "5", and "6" are black. It is also contemplated by the present invention that the dice used can be entirely conventional, in both number format and color.

At commencement, the players place their bets on their respective betting areas 27. The dealer 17 then provides the requisite number of dice 37 to each of the players and then to the dealer 17. In this regard, a presently preferred version of the invention utilizes a pair of the dice 37 for use in the play of the game. As mentioned previously, the dealer 17 obtains the dice 37 from the dice storage area 35.

Player #1 is then selected, either randomly or by seating position around the playing surface 11, and is the first player to throw the dice 37 into the player dice receiving area 25 that is associated with Player #1's position relative to the playing surface 11. Player #2 follows, by throwing his or her requisite number of the dice 37 into that player's dice-receiving area 25, again, with Player #2 identified by random selection or by relative position about the playing surface. In a preferred version of the game, once Player #1 has been selected, play continues in a clock-wise manner, from player to adjacent player, around and about the playing surface 11. After all of the players have thrown their respective dice, the dealer 17 throws his or her dice into the dealer's dice receiving area 31.

After the dice of the dealer 17 have been thrown, each of the players adds up the face value of each of their dice in their respective player dice-receiving areas 25, and compares this total to the face value total of the dice of the dealer 17 in the dealer dice-receiving area 31. In the case of each such comparison, the winning face count as between a particular player and the dealer is the one of highest numerical value. For example, if two dice are used, the lowest possible value is "2", and the highest is "12". If the dealer throws a "10", the dealer will prevail against any player throwing "9" or less, and the dealer will lose against players throwing an "11" or "12". When the player and the dealer have the same total face point value, the bet is considered a "tie", and there is no action.

In a presently preferred version of the inventive dice game, certain of the point values are considered to be "wild," and will win over other point values that are numerically greater. In the instance where two dice are used, players possessing dice totals of "2", "11" or "12" will WIN, regardless of the point value of the dealer's dice. Alternatively, if the dice total for the dealer is "3", the dealer will WIN, regardless of the point value of the player, unless such player point value is "2", "11", or "12", in which case, as is noted above, the player will win.

As discussed previously, each player and the dealer throw the requisite number of dice into their respective dice-receiving areas. While such areas may be delineated by lines inscribed in the playing surface 17, it is presently preferred that each such area consists of a dice-receiving bowl, or like physical receiving structure (not shown in the Figures). In this manner, the dice will be retained within a physical structure that conveniently isolates each participant's dice, minimizing the opportunities for confusion as well as enhancing the bouncing and random selection process of the dice themselves.

My invention has been disclosed in terms of a preferred manner of play, which provides an improved dice game of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A method of playing a casino game comprising the steps of:

providing a plurality of player positions, each player position having a player betting area;

starting each game by providing a pre-selected number of dice taken from a dice storage area, or their video or mechanical equivalent, to each player position having a previously-placed bet in the related player betting area;

providing the pre-selected number of dice taken from the dice storage area, or their video or mechanical equivalent, to a dealer or house position;

throwing the pre-selected number of dice previously provided to each of the player positions in a manner whereby the dice are retained within a respective one of a plurality of dice-receiving areas as is related to each of the specific player positions;

throwing the pre-selected number of dice previously provided to the dealer or house position in a manner whereby the dice are retained within a dealer dice receiving area;

comparing the results of each throw of the pre-selected number of dice associated with a specific player position to the results of the throw of the pre-selected number of dice by the dealer or house position;

defining a winning throw as those pre-selected number of dice having a numerically greater face value than the throw of the pre-selected number of dice with which said winning throw is compared;

rewarding each of said winning throws associated with a specific player position and collecting each bet associated with a specific player position having a nonwinning throw; and removing all dice retained within all player dice receiving areas and the dealer dice receiving area at the end of each game after all of said winning throws are defined, and placing all such dice in the dice storage area.

2. A method of playing a casino game as is described in claim 1, and further comprising the step of:

defining a "no action" result at any time the comparing step obtains a result whereby the throw of a pre-selected number of dice associated with a specific player position results in an identical numeric value to the throw of a pre-selected number of dice associated with the dealer position, whereby any bet associated with a "no action" result remains as originally placed, and is not collected by the dealer with the other non-winning throws.

3. A method of playing a casino game as is described in claim 2, wherein said step of defining a winning throw further comprises:

including within the defining of a winning throw such values associated with a specific player position as exist within a pre-defined set of player wildcard values.

4. A method of playing a casino game as is described in claim 3, wherein the step of defining a winning throw further comprises:

including within the definition of a winning throw the value associated with the dealer position where such value exists within a pre-defined set of dealer wild card values and where such values associated with a specific player position lie outside of said pre-defined set of player wildcard values.

5. A method of playing a casino game as is described in claim 4, and further comprising:

selecting said set of player wildcard values to comprise: "2", "11", and "12", and selecting said set of dealer wildcard values to comprise: "3".

6. A method of playing a casino game as is described in claim 1, wherein said throwing step further comprises throwing the pre-selected number of dice in a manner such that said dice are received and retained within a dice receiving bowl.

7. A method of playing a casino game as is described in claim 1, wherein said providing step comprises providing each player position and the dealer position with two dice.

8. A method of playing a casino dice game between at least two players, with one player being a dealer, comprising the steps of:

(a) distributing a requisite number of dice to each of the players and the dealer ;

(b) each player placing a bet;

(c) throwing the distributed dice of each player and the dealer in a sequential manner;

(d) determining a cumulative point total for each player and for the dealer using the results from the thrown dice;

(e) setting rewards based upon a sequential comparison of the cumulative point total of each player with the cumulative point total of the dealer; and (f) rewarding successful bets and the dealer collecting unsuccessful bets in accordance with step (e).

(g) setting rewards on whether the cumulative point total of each player and of the dealer are wildcard values; and wherein the rewarding of successful bets and collecting unsuccessful bets is in accordance with steps (e) and (g).

9. A method of playing a casino dice game as described in claim 8, wherein step (e) comprises setting a reward for a player having a greater cumulative point total than the cumulative point total of the dealer.

10. A method of playing a casino dice game as described in claim 9, wherein step (e) additionally comprises setting a no action result for a player having an equal cumulative point total as that of the dealer.

11. A method of playing a casino dice game as described in claim 10, wherein step (e) additionally comprises setting a losing result for a player having a smaller cumulative point total than the cumulative point value of the dealer.

12. A method of playing a casino dice game as described in claim 11, wherein step (g) comprises setting a reward for a player having a cumulative point total that comprises a player wildcard value.

13. A method of playing a casino dice game as described in claim 12, wherein step (g) additionally comprises setting a losing result when a cumulative point total for a player is not a wildcard value and where the cumulative point total for the dealer comprises a dealer wildcard value.

14. A process for playing a game of chance comprising the steps of:

(a) providing each player with a requisite number of dice;

(b) providing a dealer with the requisite number of dice;

(c) each player placing a bet;

(d) having each player roll their respective dice;

(e) having the dealer roll the dice provided the dealer after all players have rolled;

(f) calculating a point total for each player and for the dealer based upon their respective rolled dice;

(g) comparing the point total of each player with the point total of the dealer;

(h) setting rewards on the comparison of point totals between each player and the dealer, wherein the point total of a player is greater than the point total of the dealer; and (i) rewarding successful bets and the dealer collecting unsuccessful bets in accordance with step (h).

(j) setting rewards on the comparison of point totals with an array of wildcard values.

15. A process as claimed in claim 14, wherein a point total of a player comprises a player wildcard value.

16. A process as claimed in claim 14, wherein the point total of the dealer comprises a dealer wildcard value, and a point total of a player is not a player wildcard value.

17. A process as claimed in claim 14, wherein no betting action occurs where a point total of a player equals the point total of the dealer and neither point total is a wildcard value.

18. A process as claimed in claim 14, wherein a pair of dice is provided each player and the dealer, and wherein said array of wildcard values comprises "2", "11", and "12" for players and "3" for the dealer.

* * * * *